United States Patent [19]

Sexton, Jr. et al.

[11] Patent Number: 4,573,623

[45] Date of Patent: Mar. 4, 1986

[54] DIMPLER APPARATUS FOR NAIL GUNS

[76] Inventors: Joseph A. Sexton, Jr., 6398 Bocage Cir., Shreveport, La. 71119; Eric J. Vanwinkle, P.O. Box 28, Bethany, La. 71007

[21] Appl. No.: 677,398

[22] Filed: Dec. 3, 1984

[51] Int. Cl.[4] ..... B25C 1/04

[52] U.S. Cl. ..... 227/66; 227/130

[58] Field of Search ..... 227/64, 66, 130, 156

[56] References Cited

U.S. PATENT DOCUMENTS

| | | | |
|---|---|---|---|
| 2,723,532 | 11/1955 | Smith | 227/10 X |
| 2,918,675 | 12/1959 | Smith | 227/66 |
| 3,027,560 | 4/1962 | Nelson | 227/66 |
| 3,040,327 | 6/1962 | Michel | 227/66 |
| 3,774,293 | 11/1973 | Golsch | 227/66 X |

*Primary Examiner*—Paul A. Bell

*Attorney, Agent, or Firm*—John M. Harrison

[57] ABSTRACT

A dimpler apparatus for recessing nail heads in drywall panels and simultaneously dimpling the panels in the area of the recessed nail heads to expedite finishing of the panels, which includes a housing, a dimpler guide mounted on one end of the housing, a stationary stop in association with the dimpler guide, a dimpler slidably carried by the dimpler guide and the housing, a traveling stop attached to one end of the dimpler for periodically contacting the stationary stop and limiting downward travel of the dimpler, a return spring in the housing for returning the dimpler into recessed position after the dimpling operation and a driver adapted for reciprocation in the dimpler during a first increment of travel to drive nails inserted into the dimpler and slidable movement in concert with the dimpler during a second increment of travel to recess the nail heads and dimple the panels.

28 Claims, 5 Drawing Figures

DIMPLER APPARATUS FOR NAIL GUNS

BACKGROUND OF THE INVENTION

1. Field of the Invention

This invention relates to equipment for automatically driving nails and more particularly, to a dimpler apparatus for recessing or countersinking nail heads in drywall panels and dimpling the panels without penetrating or otherwise damaging the panels. The dimpler apparatus of this invention is designed in one embodiment to be installed in conventional pneumatically and electrically-operated nail guns and can be quickly and efficiently removed from the nail guns when necessary. In another embodiment, the dimpler apparatus can be fitted with self-contained pneumatic or electric drive means for cooperating with the dimpler mechanism to drive nails and dimple the drywall panels.

One of the problems encountered in the installation of the "drywall", "sheetrock" and "gypsum board" panels, which are synonymous names for a single material, (hereinafter referred to as "drywall" panels) in homes and office buildings, is the surface preparation necessary to insure a smooth interior finish on the panels. The drywall panels are characterized by a chalky gypsum core laminated between paper sheets and are typically installed by nailing the panels in abuting relationship to the studs or ceiling joists of a structure. The specifically configured drywall nails are usually recessed in the drywall panels by use of a hammer, but this procedure frequently damages the protective paper cover and sometimes allows moisture to penetrate the panel, causing deterioration and loosening from the wall or ceiling. Damaging of the outer paper covering also reduces the strength of the drywall mount, since the nail head will not seat securely in the gypsum core. This recessing or countersinking of the drywall nail head is necessary in order to smoothly "float" the wall-smoothing material, commonly called "mud" in the "taping and floating", or panel surface finishing operation, which is well known to those skilled in the art.

2. Description of the Prior Art

The recessing or countersinking of drywall nails in drywall panels is commonly undertaken by a hammer, as described above. However, since the extent of the countersinking is a function of both the force imparted to the hammer and the hardness and density of the underlying stud or roof joist which receives the nail, it follows that the recessed countersunk area is not uniform. Furthermore, the use of a hammer to achieve the desired recessing frequently damages the protective outer layer of the gypsum panel and allows rapid water penetration into the gypsum layer, or exposure of the gypsum core to the nail head, either of which can cause a panel to loosen on the drywall nails and the wall or ceiling base to which it is attached.

Accordingly, it is an object of this invention to provide a dimpler apparatus which can be quickly and easily attached to existing pneumatic and electric nail guns for the purpose of uniformly recessing or countersinking the heads of drywall nails in drywall panels without damaging the exterior paper coating of the panels.

Another object of the invention is to provide a new and improved dimpling apparatus for recessing or countersinking the heads of drywall nails immediately following the nail driving operation, which apparatus is provided in cooperation with the nail driving component of a conventional electric or pneumatic nail gun.

Yet another object of the invention is to provide a dimpling device for installation on conventional nail guns, which device provides a uniform recessing, countersinking or dimpling of drywall material in the area around the driven and recessed drywall nails, as well as the nails themselves, notwithstanding the variation in density and hardness of the underlying studs, roof joists or other base to which the drywall is attached.

A still further object of this invention is to provide a drywall dimpling apparatus which is capable of attachment to an existing nail gun and operating in association with a nail driving piston provided in the nail gun, to recess, countersink and dimple the drywall at the nail heads, in order to facilitate a more expeditious and smoother "taping and floating" finishing of the panels.

Another object of the invention is to provide a dimpling apparatus for use in association with conventional nail guns, which apparatus includes a dimpler body slidably cooperating with a nail-engaging and driving hammer component to countersink each drywall nail after the nail is driven by the nail engaging hammer, and in cooperation with the hammer, to rapidly and uniformly dimple the drywall panel area surrounding each nail head.

A still further object of this invention is to provide a dimpling apparatus for use in cooperation with an existing automatic nail gun or as a self-contained unit, which dimpling apparatus is capable of decreasing the time required for mounting drywall panels, facilitates driving and dimpling of drywall nails in areas which are difficult to reach by hand and is simple in design and easy to operate, clean and repair.

Still another object of the invention is to provide a drywall nail recessing and dimpling apparatus which can be designed to operate as a separate unit or to operate with conventional pneumatic or electric nail guns, which apparatus is characterized by a reciprocating hammer or driver, a dimpling tool in slidable association with the driver and designed to cooperate with the driver in a common increment of travel to recess the heads of drywall nails driven into drywall panels by operation of the driver and dimple the drywall by operation of the dimpler in the course of recessing the nail heads, in order to facilitate more expeditious "taping and floating" or finishing of the drywall panels.

SUMMARY OF THE INVENTION

These and other objects of the invention are provided in a dimpler apparatus which can be designed for operation with existing pneumatic or electric nail guns or independently in a self-contained machine to better prepare drywall panels for "taping and floating", which dimpler apparatus includes as a major component, a cylindrically shaped dimpling tool which slidably cooperates in a housing with a reciprocating nail driving hammer or driver and is designed to facilitate a first travel sequence of the driver to receive and drive a nail into a panel of drywall material and a limited, coordinated travel of the dimpling tool which corresponds to a second interval of travel of the driver to effect the desired countersinking of the nail and dimpling of the drywall panel.

BRIEF DESCRIPTION OF THE DRAWING

The invention will be better understood by reference to the accompanying drawings, wherein.

DESCRIPTION OF THE PREFERRED EMBODIMENTS

Figure 1:
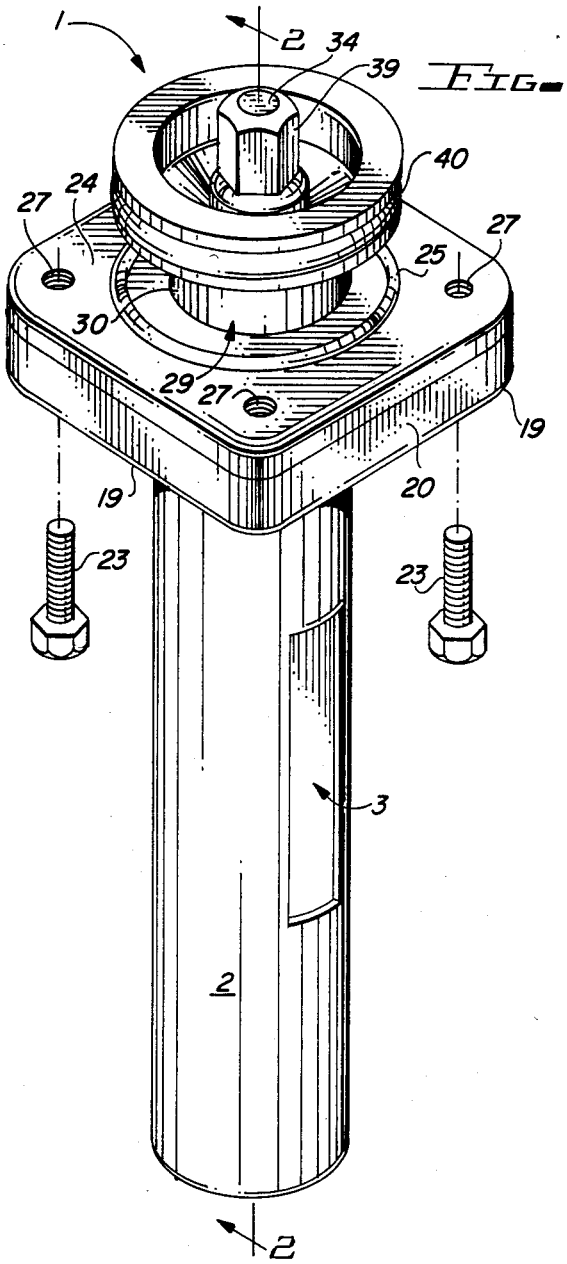
FIG. 1 is a perspective view of a preferred embodiment of the dimpler apparatus of this invention.
Figure 2:
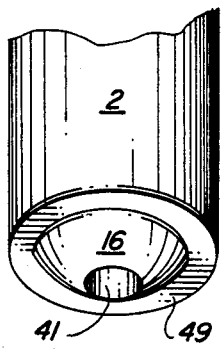
FIG. 2 is a perspective view, partially in section, of the bottom end of the dimpler apparatus illustrated in FIG. 1, with the dimpler apparatus in dimpling configuration.
Figure 3:
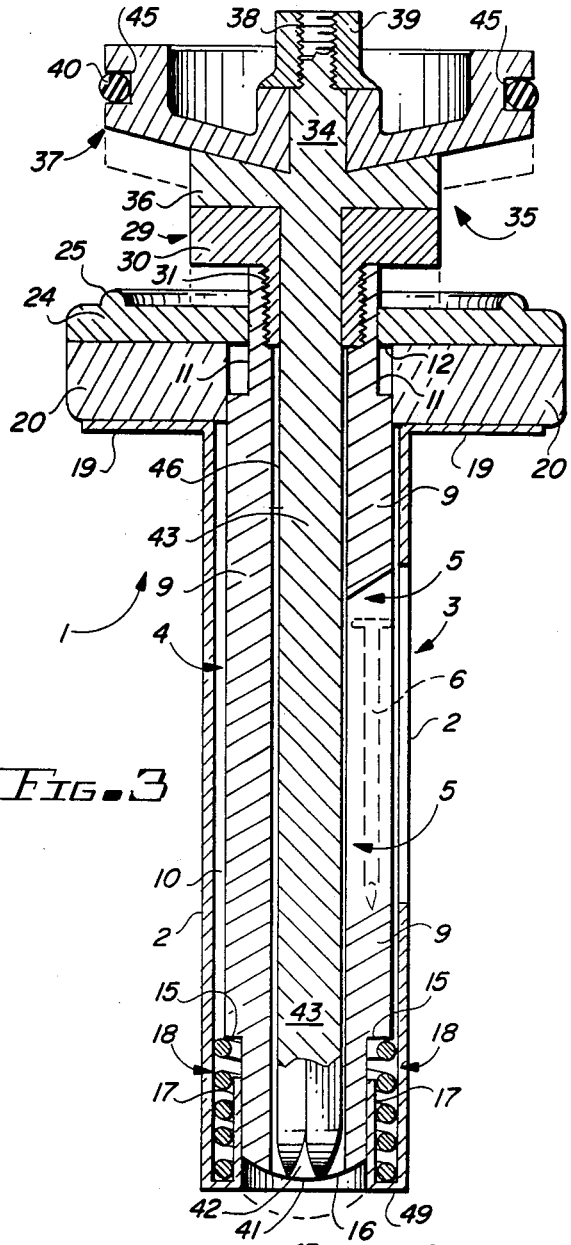
FIG. 3 is a sectional view, taken along line 2—2 in FIG. 1, of the dimpler apparatus illustrated in FIG. 1, with the dimpler apparatus in non-dimpling configuration.
Figure 5:
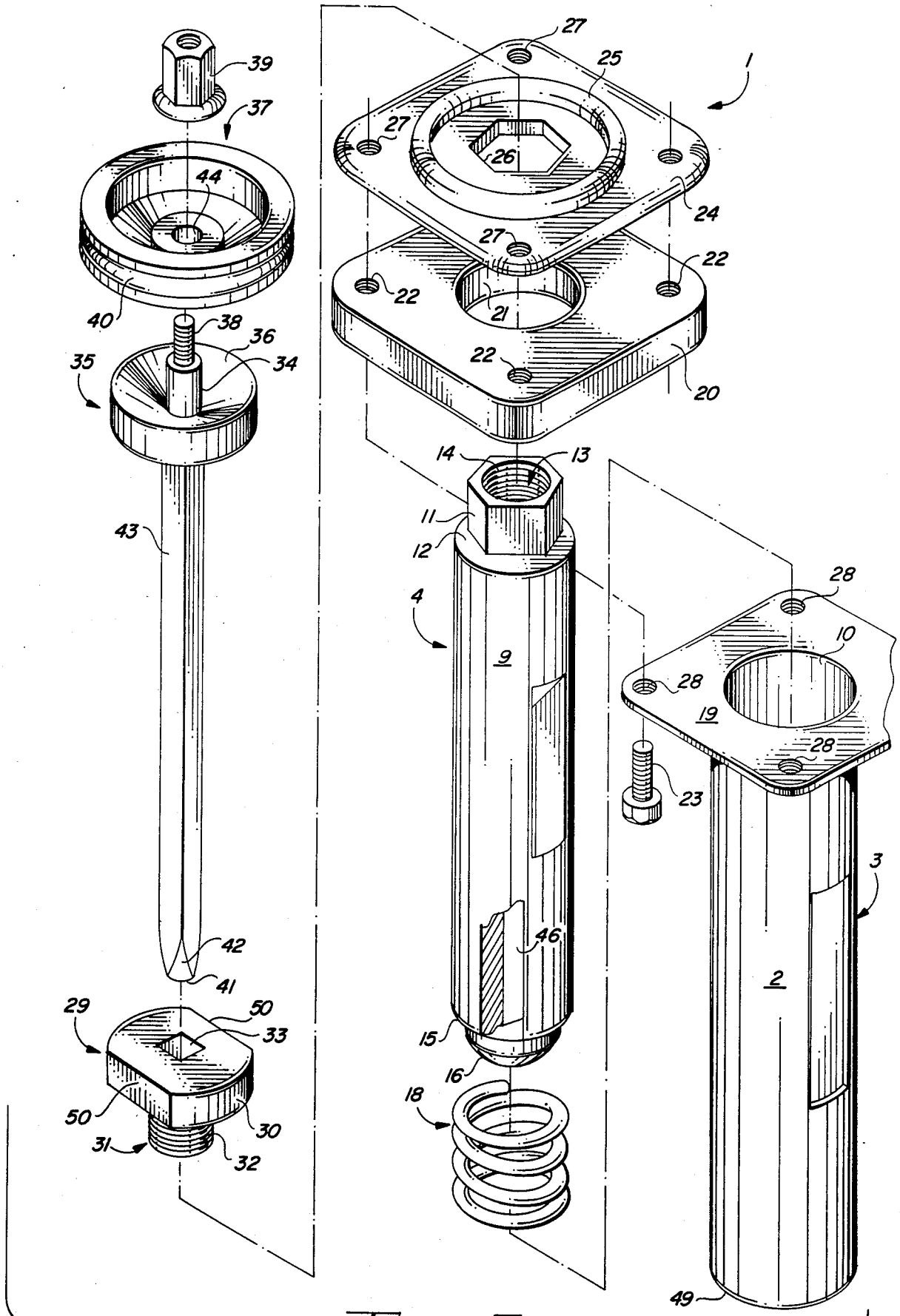
FIG. 5 is an exploded view of the dimpler apparatus illustrated in FIGS. 1–4.

Referring initially to FIGS. 1, 3 and 5 of the drawings, in a most preferred embodiment the dimpler apparatus of this invention is generally illustrated by reference numeral 1. The dimpler apparatus 1 is further characterized by a generally cylindrically-shaped housing 2, provided with a housing flange 19, which is secured to a dimpler guide 20 by means of mount bolts 23. The mount bolts 23 register with flange mount holes 28 in the housing flange 19 and with registering dimpler guide mount holes 22, provided in the dimpler guide 20. A stationary stop 24, provided with an air seal lip 25 on the top surface thereof, is bolted to the dimpler guide 20 by means of the mount bolts 23, which project through the stationary stop mount holes 27. The mount bolts 23 extend beyond the stationary stop 24 and threadibly engage the housing of a nail gun (not illustrated) as hereinafter described, to mount the dimpler apparatus 1 to the nail gun. As illustrated in FIG. 5 of the drawings the dimpler guide opening 21, provided in the dimpler guide 20, is larger than the hexagonallyshaped stationary stop opening 26, provided in the stationary stop 24. This design facilitates extension of a hexagonally-shaped dimpler neck 11, projecting from the cylindrically-shaped dimpler body 9 of a dimpler 4, through the dimpler guide opening 21 and in registration with the hexagonal stationary stop opening 26, with the top dimpler shoulder 12 normally engaging the bottom surface of the stationary stop 24, as illustrated in FIG. 3. The dimpler body 9 is slidably positioned in a cylindrical housing opening 10, provided in the housing 2, the dimpler neck 11 is provided with a neck bore 13, which is internally threaded to define neck bore threads 14 and a nail access slot 5 is provided longitudinally in the dimpler body 9, to sequentially receive a supply of nails, as hereinafter described. A bottom dimpler shoulder 15 is also provided in the dimpler 4 and the extreme projecting bottom end of the dimpler 4 terminates in a rounded dimpler base 16, which contacts the drywall responsive to downward travel of the dimpler 4, as hereinafter further described. This downward travel of the dimpler 4 is limited by means of a traveling stop 29, which is characterized by a traveling stop plate 30, having a traveling stop opening 33 provided therein and extending through a traveling stop nipple 31, projecting from the bottom of the traveling stop plate 30 and provided with external nipple threads 32. The nipple threads 32 threadibly engage the neck bore threads 14 in the neck bore 13 of the dimpler 4, to removably secure the dimpler 4 in sliding operation in the housing opening 10 with respect to the dimpler guide 20 and the stationary stop 24, which are bolted together by means of the mount bolts 23, as heretofore described. Wrench flats 50 are provided on opposite sides of the traveling stop 29 in order to provide a means for tightening the traveling stop nipple 31 in the dimpler neck 11. The dimpler 4 is further provided with a dimpler opening 46, which extends through the entire length of the dimpler body 9 and communicates with the neck bore 13. The dimpler opening 46 is designed to slidably accommodate the driver shaft 43 of a driver 35, as illustrated in FIGS. 3 and 5. In a preferred embodiment of the invention, the dimpler opening 46, traveling stop opening 33 and driver shaft 43, which is slidably inserted in the traveling stop opening 33 and the dimpler opening 46, are square in cross-section. The driver shaft 43 is further provided with a tip bevel 42, which defines a round driver tip 41 for contact with a drywall nail, as hereinafter described. The upper end of the driver shaft 43 is fitted with a driver flange 36 and a threaded boss 34 extends the driver shaft 43 above the driver flange 36. Boss threads 38 terminate the threaded boss 34 and are designed to extend through the driver head opening 44 in a driver head 37, to secure the driver head 37 tightly to the threaded boss 34, as illustrated in FIGS. 2, 3 and 5. The driver 35 is secured to the driver head 37 by means of a lock nut 39, which threads on the boss threads 38 and seats on the threaded boss 34, as illustrated. The driver head 37 is further provided with an O-ring groove 45, which receives an O-ring 40 and is designed to mount in the cylinder of a conventional nail gun or alternative drive means (not illustrated) to effect reciprocation of the driver shaft 43 with respect to the housing 2, stationary stop 24 and dimpler guide 20. The O-ring 40 seals the driver head 37 in the cylinder and the lip 25 serves to help seal air inside the cylinder to more efficiently reciprocate the driver head 37.

As further illustrated in FIGS. 2–5 of the drawings the dimpler body 9 of the dimpler 4 is disposed in the housing opening 10 of the housing 2 and a nail port 3, provided in the housing 2, is designed to register with the nail access slot 5 provided in the dimpler body 9, as illustrated in FIG. 3. Accordingly, referring again to FIG. 3, a loaded nail shown in phantom as reference numeral 6, can be inserted through the registering nail port 3 and nail access 5 and into the dimpler opening 46 when the driver shaft 43 is extended in the dimpler opening 46 to locate the driver tip 41 above the nail access slot 5. This configuration of the driver shaft 43 and driver tip 41 faciliates driving of the nail 6, as hereinafter described. The housing 2 further includes a spring seat 17, containing a dimpler return spring 18, which is designed to engage the bottom dimpler shoulder 15 in the dimpler body 9 when the dimpler 4 is inserted in the housing 2, as illustrated in FIG. 3. When the dimpler 4 is so mounted in the housing 2 and the driver 35 is in functional position with the driver shaft 43 inserted in the dimpler opening 46 and in a downstroke configuration, the driver tip 41 of the driver shaft 43 corresponds to and aligns with the dimpler base 16 of the dimpler 4 and the bottom dimpler shoulder 15 engages the dimpler return spring 18 without tensioning the dimpler return spring 18. Under these circumstances, the dimpler base 16 and the driver tip 41 are spaced a short distance from the housing bottom 49 of the housing 2, as illustrated in FIG. 3.

Figure 4:
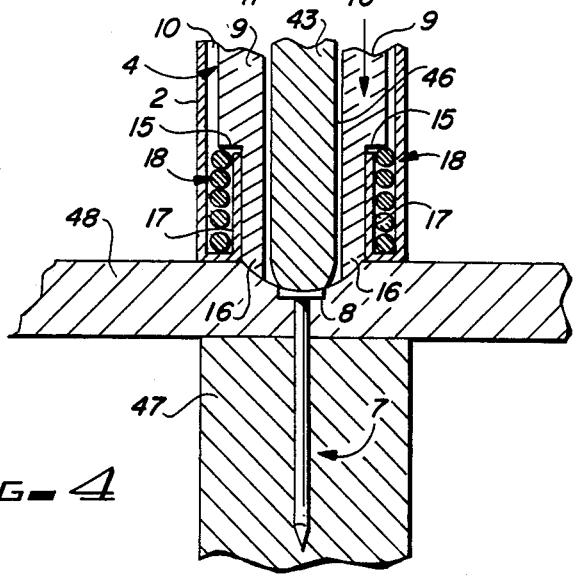
FIG. 4 is a sectional view of the bottom segment of the dimpling tool illustrated in FIGS. 2 and 3, with the dimpler apparatus in dimpling configuration.

Referring now to FIGS. 1–5 and particularly to FIGS. 2 and 4 of the drawings, under circumstances where the driver head 37 is forced downwardly by a cooperating pneumatic or electric drive mechanism (not illustrated) to complete the driving of a driven nail 7 through a panel of drywall 48 and into a supporting stud 47, the driver tip 41 forces the driven nail 7 from an initial position extending into the dimpler opening 46 adjacent the nail aperture 5, to a position where the nail head 8 is approximately flush with the top surface of the drywall 48. When the driver shaft 43 reaches this downstroke position where the driver tip 41 is in alignment with the dimpler base 16 of the dimpler 4, continued downward movement of the driver head 37 causes the driver flange 36 on the driver shaft 43 to contact the traveling stop plate 30 and causes the dimpler 4 to travel downwardly in concert with the driver shaft 43 and against the bias of the dimpler return spring 18, to further recess the nail head 8 and the driven nail 7 into the drywall 48 and provide a dimple in the drywall 48, as illustrated in FIGS. 2 and 4. The dimpler base 16 and the driver tip 41 are caused to continue moving in concert and the driver tip 41 recesses the nail head 8 into the drywall 48, until the traveling stop plate 30 contacts the stationary stop 24 to terminate the travel of both the driver shaft 43 and the dimpler 4. When pressure is released from the driver head 37, the bias in the dimpler return spring 18 causes the dimpler body 9 to travel upwardly along with the driver shaft 43, to the position illustrated in FIG. 3 of the drawings.

Further in operation and referring again to the drawings, when the driver shaft 43 is in the position illustrated in FIG. 3, and extrapolating from the position of the driven nail 7 as illustrated in FIG. 4, the driven nail 7 is extended through the drywall 48 to a point where the nail head 8 would be approximately in alignment with the top surface of the drywall 48. The driven nail 7 was formerly in the position of the loaded nail, illustrated in phantom as reference numeral 6 and located in the nail aperture 5 of the dimpler 4. The loaded nail 6 is the last nail in a series of several nails provided in a conventional spring-loaded clip (not illustrated) which can be attached to the housing 2 by means well known to those skilled in the art. Accordingly, as each loaded nail 6 moves into the relative position in the nail access slot 5 as illustrated in FIG. 3, the driver shaft 43 is moving upwardly responsive to the motion of the driver head 37 and appropriate mechanical means (not illustrated) provided in the nail gun, which means are also well known to those skilled in the art. The driver shaft 43 continues its upward travel with the dimpler 4 located in the relative position illustrated in FIG. 3, until the driver tip 41 extends above the nail aperture 5, whereupon the spring bias in the nail clip (not illustrated) exerted vicariously against the loaded nail 6, causes the loaded nail 6 to move into the dimpler opening 46 and in the path of the driver shaft 43. As the driver shaft 43 begins its downward motion responsive to the downward bias of the driver head 37, the driver tip 41 contacts the slightly concave nail head 8 of the loaded nail 6 and forces the loaded nail 6 through the drywall 48 and into the stud 47, into the position of the driven nail 7, but not yet in the countersunk or recessed configuration illustrated in FIG. 4. As the driver shaft 43 drives the driven nail 7 through the drywall 48 and into the stud 47 and the driver flange 36 to the driver 35 contacts the traveling stop 29, the driver tip 41 of the driver shaft 43 is aligned with the dimpler base 16 of the dimpler 4 and the dimpler 4 is also forced downwardly in concert with the driver shaft 43. The bottom dimpler shoulder 15 compresses the dimpler return spring 18 responsive to the downward pressure of the driver head 37 and the dimpler base 16 moves downwardly against the bias of the dimpler return spring 18, to compress the outer surface of the drywall 48, as illustrated in FIG. 4. Since the driver shaft 43 is also moving downwardly at the same speed as the dimpler 4, this action causes the driver tip 41 to recess the nail head 8 below the plane of the outside surface of the drywall 38, which action, in cooperation with the dimple in the outside surface, facilitates a more expedient finishing of the outside surface. When the dimpler base 16 and driver tip 41 have extended into the drywall 48 to the point where the traveling stop plate 30 contacts the stationary stop 24 and the top dimpler shoulder 12 is displaced from the bottom surface of the stationary stop 24, as illustrated by the phantom lines in FIG. 3, pressure is released from the driver head 37 and the bias in the dimpler return spring 18 causes the dimpler 4 to return to the position illustrated in FIG. 3. The driver shaft 43 is caused to return to the driving position when the driver tip 41 is located above the nail access slot 5. The dimpler apparatus 1 is then in configuration for driving another loaded nail 6 through the drywall 48 and into the stud 47 and again dimpling the drywall 48.

Referring again to FIG. 5 of the drawings, it will be appreciated that the hexagonal stationary stop opening 26 in the stationary stop 24 serves to receive the hexagonal dimpler neck 11 in order to prevent the dimpler 4 from rotating in the housing opening 10 and misaligning the nail port 3 and nail access slot 5. Furthermore, the square traveling stop opening 33 in the traveling stop 29 and the square dimpler opening 46, in the dimpler body 9 are designed to prevent rotation of the driver shaft 43 in the dimpler body 9. It will be appreciated that the stationary stop opening 26, dimpler opening 46 and the traveling stop opening 33 can be shaped in the form of any polygon, as desired, so long as the dimpler neck 11 and driver shaft 43 are of like configuration, respectively.

It will be appreciated by those skilled in the art that a primary advantage of the dimpler apparatus of this invention is the versatility of the apparatus, in that the apparatus can be manufactured as a separate item in combination with any means for reciprocating the driver head 27 which is known to those skilled in the art, or it can be used in combination with one of several nail guns currently on the market. For example, the dimpler apparatus 1 can be used in association with the "Senco" nail gun manufactured by Senco Products, Inc., of Cincinatti, Ohio. The dimpling apparatus 1 can be used in cooperation with pneumatic and electrically operated nail guns which are known to those skilled in the art, by simply removing the existing nail driving external tool head and bolting the dimpling apparatus 1 to the housing, using the existing mount bolts 23. The dimpler apparatus of this invention fastens drywall panels according to accepted building industry standards and practices and will recess a nail of standard design and dimension normally used to attached drywall panels to studs, ceiling joists or any other nail-permeable base. The dimple created by the dimpler apparatus of this invention is uniform in depth and configuration regardless of the relative hardness and density of the underlying base to which the drywall is attached. Furthermore, the dimpler apparatus 1 can be used in cooperation with standard nail clips and drywall nails which are used in conventional nail guns and the device is designed to quickly and easily bolt onto a conventional nail gun in a short time. The tool is modular in construction, has few moving parts and is easy to clean, operate and maintain.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A dimpler apparatus for driving nails and providing dimples in a drywall panel comprising:

(a) a housing;

(b) bias means provided in one end of said housing;

(c) guide means carried by the opposite end of said housing; a bore extending transversly into said guide means; and a stop opening extending said bore through said guide means and having a cross-section shaped in the configuration of a first polygon;

(d) dimpler means slidably disposed in said housing and said bore in said guide means, with one end of said dimpler means in contact with said bias means and the opposite end of said dimpler means shaped in the configuration of said first polygon and slidably disposed in said stop opening; stop means in association with said opposite end of said dimpler means, said stop means contacting said guide means when said bias means is not tensioned by said dimpler means; and a dimpler opening extending through said dimpler means;

(e) a traveling stop carried by said opposite end of said dimpler means, said traveling stop normally spaced from said guide means when said bias means is not tensioned by said dimpler means, and a traveling stop opening in said traveling stop, said traveling stop opening communicating with said dimpler opening;

(f) nail access means provided in said housing and said dimpler means, said nail access means communicating with said dimpler opening; and (g) a driver shaft slidably disposed in said traveling stop opening and said dimpler opening, with one end of said driver shaft adapted to drive nails, and stop means provided on said driver shaft for limiting the travel of said driver shaft, whereby reciprocation of said driver shaft in a first increment of travel effects contact between said one end of said driver shaft and nails sequentially fed into said dimpler opening to drive the nails into the drywall panel, and displacement of said dimpler means against the bias of said bias means in concert with said driver shaft in a second increment of travel creates dimples in the panels.

2. The dimpler apparatus of claim 1 wherein said dimpler opening, said traveling stop opening and the cross-section of said driver shaft are shaped in the configuration of a second polygon.

3. The dimpler apparatus of claim 1 wherein said bias means is a coil spring and said nail access means is a nail port provided in said housing and a nail access slot provided in said dimpler means, said nail access slot provided in registration with said nail port.

4. The dimpler apparatus of claim 1 wherein said dimpler opening, said traveling stop opening and the cross-section of said driver shaft are shaped in the configuration of a second polygon and said bias means is a coil spring.

5. The dimpler apparatus of claim 4 wherein said second polygon is a square.

6. The dimpler apparatus of claim 1 wherein said dimpler opening and said traveling stop opening and the cross-section of said driver shaft are shaped in the configuration of a square, said bias means is a coil spring, said nail access means is a nail port provided in said housing and a nail access slot provided in said dimpler means, said nail access slot provided in registration with said nail port and said first polygon is a hexagon.

7. The dimpler apparatus of claim 1 further comprising a neck projecting from said opposite end of said dimpler means, internal threads provided in said neck and a threaded nipple extending from said traveling stop, said threaded nipple cooperating with said internal threads for removably connecting said traveling stop to said dimpler means.

8. The dimpler apparatus of claim 1 further comprising a neck projecting from said opposite end of said dimpler means, internal threads provided in said neck and a threaded nipple extending from said traveling stop, said threaded nipple threadibly cooperating with said internal threads for removably connecting said traveling stop to said dimpler means and wherein said dimpler opening, said traveling stop opening and the cross-section of said driver shaft are shaped in the configuration of a square, said bias means is a coil spring and said first polygon is a hexagon.

9. The dimpler apparatus of claim 1 wherein said stop means is further characterized by a shoulder provided in said dimpler means, with said shoulder contacting said guide means.

10. The dimpler apparatus of claim 1 further comprising a neck projecting from said opposite end of said dimpler means, internal threads provided in said neck and a threaded nipple extending from said traveling stop, said threaded nipple cooperating with said internal threads for removably connecting said traveling stop to said dimpler means and wherein:

(a) said dimpler opening, said traveling stop opening and the cross-section of said driver shaft are in the configuration of a second polygon;

(b) said bias means is a coil spring;

(c) said access means is a nail port provided in said housing and a nail access slot provided in said dimpler means, said nail access slot provided in registration with said nail port;

(d) said second polygon is a square and said first polygon is a hexagon, and (e) said stop means is further characterized by a shoulder provided in said dimpler means and defining said neck, with said shoulder contacting said guide means.

11. A dimpler apparatus for use in association with a nail gun having a frame and a piston reciprocating in the frame, to provide dimples in a drywall panel, comprising:

(a) a housing provided with an internal longitudinal bore;

(b) a guide carried by one end of said housing and a guide opening provided in said guide, said guide opening having a round cross-section of substantially the same diameter as said bore and communicating with said bore;

(c) a stationary stop carried by said guide and a stationary stop opening in said stationary stop, said stationary stop opening communicating with said guide opening and said bore and having a cross-section which is smaller than said guide opening and shaped in the configuration of a first polygon;

(d) bias means provided in said bore in the opposite end of said housing;

(e) a generally cylindrically shaped dimpler slidably disposed in said guide opening and said bore of said housing and a dimpler neck projecting from one end of said dimpler, said dimpler neck having a cross-section shaped in the configuration of said first polygon and extending in slidable relationship through said stationary stop opening; a top shoulder bordering said dimpler neck and disposed against said stationary stop when said bias means is not tensioned by said dimpler; a bottom shoulder provided in the opposite end of said dimpler in contact with said bias means; and a dimpler opening provided longitudinally in said dimpler, said dimpler opening having a dimpler opening cross-section shaped in the configuration of a second polygon;

(f) a traveling stop attached to said dimpler neck of said dimpler, said traveling stop normally spaced from said stationary stop when said bias means is not tensioned; by said dimpler; and a traveling stop opening provided in said traveling stop, said traveling stop opening communicating with said dimpler opening and having a traveling stop cross-section shaped in the configuration of said second polygon;

(g) nail access means provided in said housing and said dimpler for sequentially receiving nails in said dimpler opening;

(h) a driver shaft having a shaft cross-section shaped in the configuration of said second polygon and slidably disposed in said traveling stop opening and said dimpler opening, with one end of said driver shaft provided in association with the piston in the nail gun and the opposite end of said shaft adapted to drive a nail; and (i) shaft stop means provided on said driver shaft for terminating solo travel of said shaft, whereby said driver shaft is caused to reciprocate solo through a first range of travel in said traveling stop and said dimpler opening to drive a nail in the panel and said dimpler means and said driver shaft are caused to operate in concert through a second range of travel to dimple the panel.

12. The dimpler apparatus of claim 11 wherein said nail access means further comprises a nail port in said housing and a nail access slot in said dimpler, said nail access slot provided in registration with said nail port and in communication with said dimpler opening.

13. The dimpler tool of claim 11 wherein said bias means is a coil spring.

14. The dimpler apparatus of claim 11 wherein:

(a) said nail access means further comprises a nail port in said housing and a nail access slot in said dimpler, said nail access slot provided in registration with said nail port and in communication with said dimpler opening; and (b) said bias means is a coil spring.

15. The dimpler apparatus of claim 11 wherein said first polygon is a hexagon.

16. The dimpler apparatus of claim 11 wherein:

(a) said nail access means further comprises a nail port in said housing and a nail access slot in said dimpler, said nail access slot provided in registration with said nail port and in communication with said dimpler opening;

(b) said bias means is a coil spring; and (c) said first polygon is a hexagon.

17. The dimpler apparatus of claim 11 wherein said second polygon is a square.

18. The dimpler apparatus of claim 11 wherein:

(a) said nail access means further comprises a nail port in said housing and a nail access slot in said dimpler, said nail access slot provided in registration with said nail port and in communication with said dimpler opening;

(b) said bias means is a coil spring; and (c) said second polygon is a square.

19. The dimpler apparatus of claim 11 wherein said first polygon is a hexagon and said second polygon is a square.

20. The dimpler apparatus of claim 11 wherein:

(a) said nail access means further comprises a nail port in said housing and a nail access slot in said dimpler, said nail access slot provided in registration with said nail port and in communication with said dimpler opening;

(b) said bias means is a coil spring;

(c) said first polygon is a hexagon; and (d) said second polygon is a square.

21. A dimpler apparatus for countersinking drywall nails and dimpling drywall panels comprising:

(a) a generally cylindrically shaped housing having an internal housing bore extending longitudinally therethrough;

(b) a coil spring disposed in said housing bore;

(c) a dimpler guide removably carried by one end of said housing, and a guide opening provided in said dimpler guide, said guide opening communicating with said housing bore and substantially the same diameter as said housing bore;

(d) a stationary stop carried by said dimpler guide and a stop opening provided in said stationary stop, said stop opening smaller than said guide opening and shaped in the configuration of a first polygon;

(e) a generally cylindrically-shaped dimpler slidably disposed in said housing bore and said guide opening; a dimpler bore having a cross-section shaped in the configuration of a second polygon and extending longitudinally through said dimpler; a top shoulder shaped in one end of said dimpler and an internally threaded neck projecting from said top shoulder, said neck shaped in the configuration of said first polygon and slidably disposed in said stop opening, with said top shoulder resting against said stationary stop when said bias means is not tensioned by said dimpler, and a bottom shoulder shaped in the opposite end of said dimpler, said bottom shoulder engaging said coil spring in said housing bore;

(f) a traveling stop having a traveling stop nipple provided with external nipple threads threadibly cooperating with said internally threaded neck of said dimpler, for removably securing said traveling stop to said dimpler, said traveling stop further provided with a traveling stop opening having a cross-section shaped in the configuration of said second polygon and spaced from said stationary stop when said coil spring is not tensioned by said dimpler;

(g) a nail port in said housing and a nail access slot in said dimpler, said nail access slot provided in registration with said nail port and both said nail port and said nail access slot situated in communication with said dimpler bore, whereby nails may be sequentially introduced into said dimpler bore; and (h) a driver adapted for reciprocation and characterized by a driver shaft having a cross-section shaped in the configuration of said second polygon and slidably disposed in said dimpler bore and said traveling stop opening and a driver flange provided on one end of said driver shaft and adapted for periodic contact with said traveling stop responsive to reciprocation of said driver shaft in said dimpler bore and said traveling stop opening, whereby said driver shaft reciprocates in a first increment of travel to drive nails inserted in the dimpler bore into the panels and in a second increment of travel moving in concert with said dimpler to countersink the nail heads and dimple the drywall panels.

22. The dimpler apparatus of claim 21 further comprising a spring seat provided in the opposite end of said housing and extending into said housing bore for supporting said coil spring.

23. The dimpler apparatus of claim 21 wherein said first polygon is a hexagon.

24. The dimpler apparatus of claim 21 wherein said second polygon is a square.

25. The dimpler apparatus of claim 21 wherein said first polygon is a hexagon and said second polygon is a square.

26. The dimpler apparatus of claim 21 further comprising a spring seat provided in the opposite end of said housing and extending into said housing bore for supporting said coil spring and wherein said first polygon is a hexagon and said second polygon is a square.

27. The dimpler apparatus of claim 21 further comprising mount apertures in registering relationship in said housing, said dimpler guide and said stationary stop and mount bolts extending through said mount apertures for securing said housing, said dimpler guide and said stationary stop together.

28. The dimpler guide of claim 21 wherein said first polygon is a hexagon and said second polygon is a square and further comprising:

(a) a spring seat provided in the opposite end of said housing and extending into said housing bore for supporting said coil spring; and (b) mount apertures in registering relationship in said housing, said dimpler guide and said stationary stop and mount bolts extending through said mount apertures for securing said housing, said dimpler and said stationary stop together.

* * * * *